US006645453B2

(12) United States Patent
Singh et al.

(10) Patent No.: US 6,645,453 B2
(45) Date of Patent: Nov. 11, 2003

(54) SOLVENT EXTRACTION PROCESS FOR RECOVERY OF URANIUM FROM PHOSPHORIC ACID (25-55% P205)

(75) Inventors: Harvinderpal Singh, Mumbai (IN); Shyamkant Laxmidutt Mishra, Mumbai (IN); Ravishankar Vijayalakshmi, Mumbai (IN); Ashok Basawanthappa Giriyalkar, Mumbai (IN); Chiranjib Kumar Gupta, Mumbai (IN)

(73) Assignee: Secretary, Department of Atomic Energy, Government of India, Mumbai (IN)

( * ) Notice: Subject to any disclaimer, the term of this patent is extended or adjusted under 35 U.S.C. 154(b) by 36 days.

(21) Appl. No.: 09/947,349

(22) Filed: Sep. 7, 2001

(65) Prior Publication Data

US 2003/0113247 A1 Jun. 19, 2003

(51) Int. Cl.[7] ..... C01B 25/16; C22B 60/02
(52) U.S. Cl. ..... 423/321.2; 423/10
(58) Field of Search ..... 423/10, 321.2

(56) References Cited

U.S. PATENT DOCUMENTS 3,835,214 A * 9/1974 Hurst et al. ..... 423/10
4,385,037 A * 5/1983 Paris et al. ..... 423/10
4,402,920 A * 9/1983 Lopez et al. ..... 423/8

OTHER PUBLICATIONS

Murthy et al., "Study of some phenyl phosphoric acids for extraction of uranium from phosphoric acid", Proceedings of a symposium on the recovery of uranium from its ores and other sources organized by the international Atomic Energy Agency (1971), 341–350.*

* cited by examiner

*Primary Examiner*—Stanley S. Silverman
*Assistant Examiner*—Maribel Medina
(74) *Attorney, Agent, or Firm*—Birch, Stewart, Kolasch & Birch, LLP

(57) ABSTRACT

An improved process of extraction of uranium from phosphoric acid and in particular uranium VI from phosphoric acid especially strong phosphoric acid using a selective synergistic extractant mix of an organo-phosphorous acid and a neutral extraction agent. The process basically involves the steps of extraction comprising contacting said acid with a selective synergistic extractant system of di-nonyl phenyl phosphoric acid (DNPPA) and a neutral agent selected from di-butyl butyl phosphonate (DBBP) and tri-n-octyl phosphine oxide (TOPO); and recovering the uranium values from the loaded organic phase. The above process would provide for an improved process for recovery of uranium both from weak and strong phosphoric acids using a stable and relatively cheap extractant system. The process is directed to improved recovery of U-VI from phosphoric acid by way of a simple, industrially applicable and cost-effective process.

25 Claims, No Drawings

SOLVENT EXTRACTION PROCESS FOR RECOVERY OF URANIUM FROM PHOSPHORIC ACID (25-55% P205)

The present invention relates to an improved process of extraction of uranium from phosphoric acid and in particular uranium VI from phosphoric acid especially strong phosphoric acid using a selective synergistic extractant mix of an organo-phosphorous acid and a neutral extraction agent.

Phosphates are well known to be an important sustainable secondary source of uranium. While methods of uranium extraction such as ion-exchange, membrane separation and precipitation are well known, the method of solvent extraction of uranium has been found to be a successful process for industrial recovery of uranium from phosphates.

It is well known to carry out uranium recovery from wet process phosphoric acid obtained via sulfuric acid route. There are various known solvent extraction processes, which include the OPPA process, which utilizes octyl pyrophosphoric acid as the extractant. This solvent is inexpensive but is found to be highly unstable especially during the exposure to HF, which is needed for back extraction.

It is also known to carry out solvent extraction of uranium using the OPAP process which involves the use of octyl phenyl acid phosphate consisting of mixture of mono octyl phenyl phosphoric acid (MOPPA) and di-octyl phenyl phosphoric acid (DOPPA). It is characterized with high extraction of uranium. However, it has limited solubility in diluents like kerosene and stability although comparatively better than OPPA is not very high. Moreover, the selectivity is also not very high.

U.S. Pat. No. 4,302,427 discloses the uranium extraction using the solvent mixture of di-(2-ethyl hexyl) phosphoric acid (D2EHPA) and tri-n-octyl phosphine oxide (TOPO) in a phosphoric acid immiscible organic solvent. U.S. Pat. No. 4,778,663 discloses a further process of recovery of uranium from wet process phosphoric acid involving the use of a combination of dialkyl phosphoric acid and mixture of trialkyl phosphine oxides. Such processes are characterized with low distribution ratio of uranium and essentially requires the use of relatively expensive extractant component, which is TOPO.

U.S. Pat. No. 4,238,457 discloses the use of a first stage extraction using organic solvent consisting essentially of dialkylphosphoric acid and trialkylphosphine oxide dissolved in an inert and unreactive organic solvent followed by a second stage re-extraction using ammonium hydroxide and ammonium carbonate. Such a process is cost-extensive and yields a product of low purity.

Moreover, solvent extraction processes that have been reported as successful for extraction of hexavalent uranium—the form in which uranium is generally present in phosphoric acid—involve extraction by a mixture of an organo-phosphorous acid with a neutral synergist. Thus, di-(2-ethyl hexyl) phosphoric acid (D2EHPA)-tri-n-butyl phosphate (TBP), D2EHPA-di-butyl butyl phosphonate (DBBP) and D2EHPA-tri-n-octyl phosphine oxide (TOPO) combinations have been reported. Results on DOPPA and di-nonyl phenyl phosphoric acid (DNPPA) have also been reported with their mono-ester components for extraction of tetravalent form of uranium.

It would be evident from the above that for extraction of uranium from phosphoric acids whether U-IV or U-VI is known to involve use of the combination of a organo-phosphorous acid as the basic component and a synergistic agent. Although this is generally known, it is extremely difficult to ascertain the specific combinations of phosphoric acid and the synergistic extractant agent and conditions for extraction which could achieve the desired extraction and which would be industrially applicable and be cost effective.

Importantly, lack of clear knowledge on the mechanism of extraction even for known extraction systems makes it extremely difficult to reach to a selective combination which would provide for better extraction and would also be cost effective. There are instances where apart from selection of the acid/agent for extraction, the proportion in which the two compounds acid and the agent are used determine whether it would have a synergistic effect or an antagonistic effect. This made it all the more difficult to identify the selective combination of extractant, which would provide the improved extraction by using a cost effective process. Added to the above, the knowledge of extractant for extraction from weak phosphoric acid does not have direct relevance on the selection of the extractant for extraction from strong acids. This made it difficult to provide extraction systems for strong phosphoric acids.

OBJECT OF THE INVENTION

It is thus the basic object of the present invention to provide for an improved process for recovery of uranium both from weak and strong phosphoric acids using a stable and relatively cheap extractant system.

Another object of the present invention is directed to provide for an improved process of recovery of U-VI from strong phosphoric acid using a novel selective combination of an organo-phosphorous acid and a neutral synergistic agent.

Yet further object of the present invention is to provide for a synergistic combination of a organo-phosphorous acid and a neutral synergistic agent which would provide for improved recovery of U-VI from phosphoric acid by way of a simple, industrially applicable and cost-effective process.

Yet further object of the present invention is directed to provide for a synergistic combination of the organo-phosphorous acid and TOPO/DBBP which would provide for selective and high purity yield/extraction of U-VI both from weak as well as strong phosphoric acids.

SUMMARY OF THE INVENTION

Thus according to the present invention there is provided an improved process for extraction of uranium from wet process phosphoric acid comprising:

a. steps of extraction comprising contacting said acid with a selective synergistic extractant system of di-nonyl phenyl phosphoric acid (DNPPA) and a neutral agent selected from di-butyl butyl phosphonate (DBBP) and tri-n-octyl phosphine oxide (TOPO); and b. recovering the uranium values from the loaded organic phase.

In accordance with one preferred aspect of the present invention the improved process for extraction of uranium from weak phosphoric acid (containing 26–30% $P_2O_5$) comprises:

a. steps of extraction comprising contacting said acid with said selective synergistic extractant mix of di-nonyl phenyl phosphorous acid (DNPPA) and di-butyl butyl phosphonate (DBBP) after appropriate dilution; and b. recovering the uranium values from the loaded organic phase.

In accordance with another preferred aspect of the present invention the improved process for extraction of uranium from strong phosphoric acid (containing 30–55% $P_2O_5$) comprises:

a. steps of extraction comprising contacting said acid after appropriate dilution with a selective synergistic extractant mix of di-nonyl phenyl phosphoric acid (DNPPA) and tri-n-octyl phosphine oxide (TOPO); and b. recovering the uranium values from the loaded organic phase.

Preferably, in the above discussed processes of the present invention the selective mole ratio of the extractant mix comprising of said acid DNPPA and the agent DBBP/TOPO comprise mole ratio of 0.05 to 0.20 M DBBP : 0.2 M DNPPA and 0.05 to 0.155 M of TOPO:0.2 M DNPPA. It was found that the extraction increased with the increase in the level of the synergistic reagent used. However, it was identified that the optimum mole ratio of synergistic reagent (DBBP/TOPO) with extractant is 1:2.

Moreover, in the above disclosed processes of the invention, both for the weak phosphoric acid as well as the strong phosphoric acid, prior to said step of extraction the acid is subjected to pre-treatment comprising steps of separation of suspended solids, separation of humic matter and oxidation. For the purpose, the humic matter was characterized by infrared (IR) spectra. It was found that long chain polymeric flocculent used for separation of suspended solids from freshly produced acid was also effective in initial removal of organic matter. Residual humic matter, not removed by clari-flocculation, was removed by carbon adsorption. As an alternative "solvent scrubbing" method can also be used. After humic matter separation, oxidation with air sparging was followed by polishing oxidation with hydrogen peroxide carried out in stages. Clear oxidized acid was subjected to solvent extraction.

Preferably, in the above process of the invention, after the extraction is effected, the barren acid is subjected to post-treatment for entrained solvent recovery. Different methods of stripping such as ammonium carbonate, HF or strong $H_3PO_4$ under reducing conditions can be followed.

In accordance with another aspect of the invention it was found that the phase continuity in the mixer played an important role, especially for MGA. With aqueous continuous operation, entrainment exceeded 300 mL/m$^3$, whereas with organic continuous, it was 130–260 mL/m$^3$. Use of a coalescer with a residence time of 13 min reduced entrainment to 18–26 mL/m$^3$.

The details of the invention, its objects and advantages are explained herein in greater detail in relation to the non-limiting exemplary illustrations.

EXAMPLES

Preparation of Extractant Mix

DNPPA was synthesized by the known procedure. A mixture of di- and mono-esters of nonyl phenyl phosphoric acid was obtained by reacting p-nonyl phenol with phosphorous oxy-chloride in the presence of pyridine in mole ratio of 2:1:2. The reaction mixture was hydrolyzed with excess of 6 M HCl at 80° C. for 12 h. The di- and mono-esters were separated by extraction from benzene solution with 70% methanol. The unreacted nonyl phenol and neutral compounds were separated by loading the benzene layer with neodymium (Nd) and precipitating the Nd-diester salt in excess acetone. Di-ester was obtained by dissolving the salt in benzene and stripping the Nd with oxalic acid. The concentrations of mono- and di-esters were determined by potentiometric titration with alkali in ethanol medium. The separated di-ester fraction contained ~2% neutral and balance di-ester. Commercially available DBBP and TOPO of 95% purity were used for the work. The diluent used was the aliphatic fraction of refined kerosene. Gas chromatography confirmed composition (%) as $C_{10}$ (14.7), $C_{11}$ (26.9), $C_{12}$ (26.2), $C_{13}$ (15.8), $C_{14}$ (16.1), with aromatic content ~0.1%. Flash point was 73° C. and density 751 kg/m$^3$. Importantly, the low aromatic content was preferred as it was found to be important for reducing entrainment losses, especially while processing MGA.

Specifications of Phosphoric Acid Used

Phosphate rock samples from operating plants as well as reserves known to contain uranium were used to make phosphoric acid. Leaching of rock was carried out with sulfuric acid at 65° C. for 2 h in the presence of $H_2O_2$ as the oxidising agent. The WPA in a typical experiment analyzed (g/L) $U_3O_8$ (0.11), $SO_3$ (45), $Fe_2O_3$ (3.9), $Al_2O_3$ (3.9), CaO (13.3), MgO (2.6), F (23). This acid was concentrated by evaporation in a water bath to >8 M $H_3PO_4$ for use in later stages of the work. Both weak and strong acids were subjected to pre-treatment which included separation of suspended solids, separation of humic matter and oxidation. After pretreatment, extraction was carried out and barren acid subjected to post-treatment for entrained solvent recovery.

Apparatus Used

Tests at 1000 L/h using a 3.5-m diameter clari-flocculator, 0.5-m diameter carbon column and polypropylene mixer-settlers. Entrained solvent recovery was carried out using a laminar coalescer and flotation cell.

Example I

A comparative study of the effect of the selective synergistic reagent with DNPPA was studied as hereunder:

For the purpose, studies were carried out on equilibrium distribution ratio (D) for extraction from synthetic 5.8 M phosphoric acid containing 0.43 g/l U3O8 using only DNPPA 0.2 M, only DBBP (0.1 M), only TOPO (0.1 M) and the selective combination of DNPPA (0.2 M)+DBBP/TOPO (0.1 M) and the results obtained are detailed hereunder in TABLE 1:

TABLE 1

| Extractant | DNPPA (0.2 M) | DBBP (0.1 M) | TOPO (0.1 M) | DNPPA + DBBP (0.2 M) + (0.1 M) | DNPPA + TOPO (0.2 M) + (0.1 M) |
|---|---|---|---|---|---|
| D Values | 0.102 | 0.02 | 0.03 | 2.00 | 2.97 |

It would be evident from the above that the extractant mix of DNPPA+DBBP/TOPO achieved a synergistic improved extraction than that achieved in the extraction of only DNPPA and only DBBP/TOPO.

Example II

The extraction achieved by the synergistic extractant mix of DNPPA+DBBP/TOPO vis-à-vis the conventional D2EHPA+TOPO was next studied as discussed hereunder.

The data on equilibrium distribution ratio (D) for extraction from synthetic 5.8 M phosphoric acid containing 0.43 g/L $U_3O_8$ using DNPPA vis-à-vis D2EHPA in combination with DBBP/TOPO are provided in Table 2 hereunder:

TABLE 2

Effect of synergistic reagent on extraction of uranium (VI) - D values

| Serial number | DBBP (M) | TOPO (M) | Mole ratio | D | |
|---|---|---|---|---|---|
| | | | | D2EHPA | DNPPA |
| 1 | 0.05 | — | 4:1 | 0.38 | 1.74 |
| 2 | 0.066 | — | 3:1 | 0.40 | 1.85 |
| 3 | 0.10 | — | 2:1 | 0.46 | 2.00 |
| 4 | 0.155 | — | 1.33:1 | 0.41 | 1.52 |
| 5 | 0.20 | — | 1:1 | 0.32 | 1.45 |
| 6 | — | 0.05 | 4:1 | 0.90 | 2.50 |
| 7 | — | 0.10 | 2:1 | 0.79 | 2.97 |
| 8 | — | 0.155 | 1.33:1 | 0.68 | 2.84 |

Aqueous feed: 5.8 M $H_3PO_4$ technical grade acid spiked with 0.43g $U_3O_8$/L.

Extractant: 0.2 M DNPPA/D2EHPA.

Mole ratio: Extractant concentration/synergistic reagent concentration.

The above results confirmed that D increases with increase in concentration of synergistic reagent to a certain level after which D decreases. The optimum mole ratio of synergistic reagent (DBBP/TOPO) with extractant was 1:2, vis-à-vis the case of D2EHPA/TOPO where it was 1:4. TOPO showed higher D value than DBBP. In view of the higher cost of TOPO in comparison with DBBP, the preferred reagent for extraction of uranium from WPA was found to be DBBP.

Example III

Effect of DNPPA concentration in the extraction process was next studied keeping the mole ratio of synergistic reagent constant. The results are given in Table 3.

TABLE 3

Effect of DNPPA concentration on extraction of U (VI) - D values

| Serial number | DNPPA concentration (M) | D in 5.8 M $H_3PO_4$ With DBBP | D in 5.8 M $H_3PO_4$ With TOPO | D in 8 M $H_3PO_4$ With TOPO |
|---|---|---|---|---|
| 1 | 0.1 | — | 2.14 | 0.49 |
| 2 | 0.2 | 1.95 | — | — |
| 3 | 0.3 | 2.25 | — | — |
| 4 | 0.4 | — | 7.05 | 1.08 |
| 5 | 0.5 | 3.38 | — | 2.4 |
| 6 | 0.6 | — | 9.1 | 2.6 |

Aqueous feed: technical 5.8/8 M $H_3PO_4$ spiked with 0.43g $U_3O_8$/L.

Organic phase: Concentration of DNPPA varied at mole ratio when synergistic reagent is 2.0.

The extraction of uranium from 5.8 and 8 M $H_3PO_4$ increased with increase in concentration of DNPPA, the increase approximates a power law with an exponent of 0.6. With 0.6 M DNPPA+0.3 M TOPO as the extractant and 8 M $H_3PO_4$ as aqueous feed, the D value of 2.6 was achieved. The extraction of U (VI) from 8 M $H_3PO_4$ was also carried out using 0.5 M D2EHPA+0.125 M TOPO and 1.0 M D2EHPA+0.25 M TOPO as the extractants. The D values were found to be 0.63 and 1.57, respectively, which were significantly lower than the values obtained in the DNPPA system.

EXAMPLE IV

The relative strength of the extractant mix of the invention in extraction of U (VI) values vis-à-vis other known extractants for U (VI) was studied and the result are detailed hereunder in Table 4.

TABLE 4

| Sl. No. | Extractants | U-form | Molar | D 8 M $H_3PO_4$ | D 5.8 M $H_3PO_4$ |
|---|---|---|---|---|---|
| 1. | DNPPA + MNPPA | U(IV) | 0.1 M + 0.1 M | 2.81 | 9.4 |
| 2. | D2EHPA + TOPO | U(VI) | 0.2 M + 0.05 M | — | 0.9 |
| 3. | DNPPA + TOPO | U(VI) | 0.2 M + 0.05 M | 0.49 | 2.50 |
| 4. | D2EHPA + DBBP | U(VI) | 0.2 M + 0.1 M | — | 0.46 |
| 5. | DNPPA + DBBP | U(VI) | 0.2 M + 0.1 M | — | 2.00 |
| 6. | D2EHPA + DBBP | U(VI) | 0.5 M + 0.25 M | 0.32 | 0.46 |
| 7. | DNPPA + DBBP | U(VI) | 0.5 + 0.25 M | 2.4 | 3.38 |
| 8. | DNPPA + TOPO | U(VI) | 0.6 M + 3 M | 2.6 | 9.1 |

It would be well apparent from the above that the synergistic extractant mix of the present invention is found to provide for better and improved extractants of Uranium (VI) from weak (5.8M) and strong (8M) phosphoric acid vis-à-vis the other presently known extractants.

Example V

Based on the above favorable results further studies on counter-current extraction from WPA was carried out as detailed hereunder:

For the purpose, the A/O ratio of 2.5, contact time of 1.5 min and five stages were used. Tests were carried out with WPA (5.8 M $H_3PO_4$), analyzing 0.11 g $U_3O_8$/L as aqueous feed. The organic phase consisting of 0.5 M DNPPA+0.25 M DBBP was used as an extractant. After reaching steady state, the stage-wise uranium analyses in both organic and aqueous phases were carried out. The extraction profile is given in Table 5. From the results, it was found that >93% of the uranium was extracted.

TABLE 5

Counter current extraction of uranium (VI) from WPA/MGA with different extractants.

| Stage No. | Uranium concentration (g/L) DNPPA-DBBP-WPA Org. phase | Uranium concentration (g/L) DNPPA-DBBP-WPA Aq. phase | Uranium concentration (g/L) DNPPA-DBBP-MGA Org. phase | Uranium concentration (g/L) DNPPA-DBBP-MGA Aq. phase | Uranium concentration (g/L) D2EHPA-TOPO-MGA Org. phase | Uranium concentration (g/L) D2EHPA-TOPO-MGA Aq. phase |
|---|---|---|---|---|---|---|
| 1 | 0.08 | <0.01 | 0.032 | 0.030 | 0.03 | 0.037 |
| 2 | 0.12 | 0.055 | 0.042 | 0.049 | 0.05 | 0.053 |
| 3 | 0.15 | 0.065 | 0.049 | 0.063 | 0.055 | 0.060 |
| 4 | 0.18 | 0.075 | 0.065 | 0.083 | 0.065 | 0.078 |
| 5 | 0.21 | 0.100 | 0.087 | 0.110 | 0.082 | 0.114 |

Counter-current Extraction From MGA

Two systems, one consisting of 1 M D2EHPA+0.25 M TOPO and the other of 0.5 M DNPPA+0.25 M DBBP, were tested separately in five stages of counter-current extraction and A/O ratio of 1.5. The feed contained 0.155 g $U_3O_8$/L. Contact time was 3 min. At steady state, organic and aqueous phases were analyzed and results are given in Table 5. Uranium recovery is found to be 80% in both systems. Importantly further additional three stages were found to increase the recovery to >90%.

Stripping of Uranium From Extract

The medium for stripping of uranium was 8–12 M $H_3PO_4$, containing log $Fe^{+2}$/L at 55–60° C. Using this reagent, the effect of phase ratio was studied. At phase ratios (O/A) of 10 and 20, the D values were found to be 0.03 and 0.015, respectively. In order to obtain concentrated uranium strip liquor, phase ratio of 20 was selected for five stages of counter-current stripping. Loaded organic phase containing 0.11g $U_3O_8$/L was stripped into a product solution containing >2 g $U_3O_8$/L.

Purification of Uranium in a Second Cycle

The strip liquor collected in the first cycle using DNPPA-DBBP was used as feed after dilution and oxidation of uranium for a second cycle. The extractant used in the second cycle was 0.3 M D2EHPA+0.075 M TOPO. However, the phase ratio was increased in view of the dilute feed and the extract was scrubbed with dilute sulfuric acid. From the loaded organic phase, uranium was stripped with 1-M ammonium carbonate solution. The strip liquor filtered to remove traces of iron precipitate. The uranium tricarbonate solution contained excess ammonium carbonate and pH was found to be 8.3. Uranium precipitation was carried out using $H_2O_2$. The neutralization was carried out with sulfuric acid. In a pH range of 34, the uranium precipitation was complete (>99%). Uranium peroxide ($UO_4$. $2H_2O$) was filtered, washed, dried and calcined at 375° C. to obtain $UO_3$ powder of >99% purity.

Example VI

A further experimental extraction of U (VI) was carried out following counter current extraction using the extractants mix of the invention as discussed hereunder:

100 litres of phosphoric acid of 45% $P_2O_5$ strength and containing 15.5 gm uranium was contacted with 150 litres of solvent counter-currently in eight stages. The barren raffinate contained 0.9 gm uranium in 100 litres. The 150 litres of uranium loaded solvent, containing 14.6 gm uranium was stripped with 7.5 litres of the stripping acid (10 M $H_3PO_4$) to which scrap iron added was 75 gm. Eight contact stages were used. A product solution of 7.5 litres containing 14.5 gm of $U_3O_8$ (>93% recovery) was obtained.

Example VII

Tests to Ascertain the Stability of the Extractant

In two parallel experiments, aliquots of 0.5 M DNPPA+0.25 M DBBP were mixed with 8 M phosphoric acid at room temperature and at 60° C., respectively for 15 days. Samples of the organic phase were withdrawn at intervals and a standard uranium extraction test was carried out. No detectable change in D was found during this period indicating good stability of the solvent towards strong acid and temperature.

The above process of the invention is thus suitable for industrial operation.

The present invention thus provides for improvement in extraction of uranium from phosphoric acid by way of a selective extractant comprising DNPPA in combination with synergistic reagents DBBP and TOPO, both for extraction on uranium (VI) from phosphoric acid (WPA/MGA). Distribution values obtained with DNPPA are higher than in the presently used systems, for commercial recovery of uranium from phosphoric acid. Preferably, for uranium recovery from WPA, DNPPA in combination with DBBP is most appropriate, while for uranium separation from MGA, DNPPA in combination with TOPO is found to be most suitable.

We claim:

1. An improved process for extraction of uranium from wet process phosphoric acid (26–55% $P_2O_5$) comprising:

a) extracting uranium by contacting said acid with a selective synergistic organic extractant system of di-nonyl phenyl phosphoric acid (DNPPA) and a neutral agent selected from the group consisting of di-butyl butyl phosphonate (DBBP) and tri-n-octyl phosphine oxide (TOPO) maintaining an aqueous to organic phase ratio of 4 to 1:1 to 2;

b) recovering the uranium values from loaded organic phase of said organic extractant system following reductive stripping using 8–12 M $H_3PO_4$ containing 10 g $Fe^{+2}$/L at 55–60° C. as a stripping media.

2. An improved process for extraction of uranium from wet process phosphoric acid as claimed in claim 1, wherein the extraction of uranium from weak (26%–30% $P_2O_5$) phosphoric acid comprises:

extracting uranium by counter current extraction of uranium from weak phosphoric acid using aqueous to organic phase ratio of 4 to 1:1 to 1.5, contact time of 0.5 to 4 minutes, and involving 3 to 10 stages of extraction.

3. A process as claimed in claim 2, wherein the organic phase used comprises 0.5 M DNPPA and 0.25 M DBBP.

4. A process claimed in claim 2, wherein the ratio of aqueous to organic phase is 2.5:1.

5. A process as claimed in claim 2, wherein the contact tome is 1.5 to 2 minutes.

6. A process as claimed in claim 2, wherein there are 5 to 8 stages of extraction.

7. An improved process for extraction of uranium from wet process phosphoric acid as claimed in claim 1, wherein the extraction of uranium from strong phosphoric acid (30–55% $P_2O_5$) comprises:

extracting uranium by counter current extraction of uranium from strong phosphoric acid using aqueous to organic phase ratio of 2 to 1:1 to 2, contact time of 1 to 5 minutes, and involving 4 to 12 stages of extraction.

8. A process as claimed in claim 7, wherein the extractant system use comprise 0.5 M DNPPA and 0.25 M DBBP.

9. A process as claimed in claim 7, wherein the ratio of aqueous to organic phase is 1.5 to 1.

10. A process as claimed in claim 7, wherein the contact time is 2 to 4 minutes.

11. A process as claimed in claim 7, wherein there are 5 to 8 stages of extraction.

12. A process as claimed in claim 1, wherein the selective mole ratio of the extractant mix used comprise of said acid DNPPA and the agent DBBP/TOPO in mole ratio of 0.05 to 0.25 M DBBP:0.2 to 0.5 M DNPPA and 0.05 to 0.33 M TOPO:0.1 to 0.66 M DNPPA.

13. A process as claimed in claim 12, wherein the selective mole ratio of the extractant mix used comprise of said agent DBBP and the DNPPA in amounts of 0.05 to 0.20 M DBBP:0.2 M DNPPA respectively.

14. A process as claimed in claim 12, wherein the selective mole ratio of the extractant mix used comprise of said agent TOPO and the acid DNPPA in amounts of 0.05 to 0.155 M TOPO 0.2 M DNPPA.

15. A process as claimed in claim 1, wherein the mole ratio of the synergistic reagent (DBBP/TOPO) with respect to DNPPA is 1:2.

16. A process as claimed in claim 1, wherein prior to said step of extraction the acid is subjected to pre-treatment comprising steps of separation of suspended solids, separation of humic matter and oxidation.

17. A process as claimed in claim 16, wherein said step of pre-treatment comprise use of long chain polymeric flocculent for initial separation of suspended solids from acid followed by carbon adsorption.

18. A process as claimed in claim 16, wherein said pre-treatment comprise solvent scrubbing.

19. A process as claimed in claim 16, wherein after humic matter separation, oxidation with air sparging was followed by polishing oxidation with hydrogen peroxide in stages.

20. A process as claimed in claim 1, wherein the acid after extraction is subjected to post-treatment for entrained solvent recovery.

21. A process as claimed in claim 1, wherein the selective extractant mix comprises DNPPA:DBBP/TOPO in the ratio of 0.2 M:0.1 M respectively.

22. A process as claimed in claim 1, further comprising the steps of collecting the medium after stripping and further subjecting the medium collected after first cycle recovery using DNPPA-DBBP as feed after dilution and carrying out oxidation of uranium in a second cycle wherein 0.3 M D2EHPA+0.075 M TOPO is used an extractant in the second cycle.

23. A process as claimed in claim 22, wherein the extract produced is scrubbed with diluted sulfuric acid.

24. A process as claimed in claim 23, wherein the scrubbed extract is stripped and the strip medium filtered to remove traces of iron precipitate.

25. A process as claimed in claim 24, wherein uranium is precipitated from the filtered strip medium by using $H_2O_2$ followed by neutralization using sulfuric acid with pH maintained in the range of 3–4 to thereby precipitate the uranium.

* * * * *